United States Patent [19]

Stuhlman

[11] 4,046,104

[45] Sept. 6, 1977

[54] FLOW COAT HEAD FOR CURTAIN COATING MACHINES

[76] Inventor: Frank Stuhlman, Rte. 126 East, Plainfield, Ill. 60544

[21] Appl. No.: 698,347

[22] Filed: June 22, 1976

[51] Int. Cl.[2] ..... B05B 1/30

[52] U.S. Cl. ..... 118/300; 118/DIG. 4; 118/324; 427/420

[58] Field of Search ..... 118/DIG. 4, DIG. 23, 118/DIG. 24, 300, 324, 24, 48, 58, 68, 200, 239, 400, 419, 629, 630; 65/348; 239/302, 327; 427/420

[56] References Cited

U.S. PATENT DOCUMENTS

| | | | |
|---|---|---|---|
| 1,976,539 | 10/1934 | Bonniksen | 118/DIG. 4 |
| 3,303,816 | 2/1967 | Lauring | 118/DIG. 4 |
| 3,341,354 | 9/1967 | Woods et al. | 118/DIG. 4 |

*Primary Examiner*—Louis K. Rimrodt
*Attorney, Agent, or Firm*—Hill, Gross, Simpson, Van Santen, Steadman, Chiara & Simpson

[57] ABSTRACT

A flow coat head for curtain coating, particularly of sheet material, employing a container for the coating material having a pair of end walls connected by an elongated tubularly-shaped body, provided with an elongated longitudinally extending slot in the wall thereof which forms the material discharge opening of the head, and extends continuously from one end of the body to the other, with the body wall peripherally extending continuously from one of its longitudinal slot edges to the other thereof, forming a slot having a transverse width at least equal to the maximum desired operating width of the material discharged, pressure being applied on said body member at opposite sides of the slot in directions to move the edges of the latter toward one another and thereby vary the effective discharge width of the slot.

13 Claims, 4 Drawing Figures

FLOW COAT HEAD FOR CURTAIN COATING MACHINES

BACKGROUND OF THE INVENTION

The present invention relates to a flow coat head for use on curtain-type coating machines, which are coming into extensive use in connection with the painting or coating of sheet stock, as for example, wall panel sheets and the like, in which a reservoir of the coating liquid is disposed above a conveyor structure adapted to carry the panels to be coated below and past the reservoir. The reservoir is provided with a suitable elongated discharge opening or slot extending entirely across the width of the panel to be coated and adapted to discharge the coating liquid in a vertical sheet or curtain-like formation, with the width of the discharge opening or slot being so dimensioned that a desired amount of coating liquid is deposited over the area of the receiving panel. By careful control of the amount of liquid discharged and the rate of travel of the receiving panel through the machine, the thickness of the deposited coating material may be quite accurately controlled, and a very uniform coating thickness can be achieved without ripples or waves to produce a very smooth finished surface.

The present types of machines of this type, while varying in details of construction, employ head structures utilizing the same basic concept with respect to the structure forming the discharge slot and the means for varying the effective width thereof to control the amount of liquid deposited upon the panel. Generally, such head structures involve the use of at least one movable blade or leaf member having an edge which defines one edge of the discharge slot, so that by lateral adjustment of such leaf the effective width of the discharge slot may be varied. It is common practice to employ a head structure comprising a fixed or rigid body having a discharge slot in its lower wall, usually of a size greater in width than the ultimate discharge slot to be employed, with the effective size of the discharge slot being controlled by a pair of leaf members carried by the head, at least one of such leaves being adjustable relative to the other for achieving the desired adjustment of the slot width. Such adjustment may be effected by a wide variety of means, as for example, cams, eccentrics, screw adjustments, etc.

A typical machine of this type is illustrated in U.S. Pat. No. 3,074,374, granted on Jan. 22, 1963 to R. Bürkle, which illustrates adjustment of the slot by eccentric means.

It will be appreciated that the use of a rigid container structure having a relatively large opening or slot in the bottom wall thereof, the effective size of which is to be controlled by one or more laterally adjustable plates or leaves, presents a number of problems in connection with the use of the machine. It will be apparent that generally it is desirable to eliminate all moving parts operating in or in contact with the coating material, both from the standpoint of operation as well as cleaning. Constructions of this type normally employ a top cover to provide access to the interior of the head, which necessitates working from the top and thus awkwardly above the device during cleaning and other operations. One solution employed to eliminate this disadvantage has been to construct the head so that it may be swivelled to one side enabling the operator to work at the side of the machine, while another solution is to so construct the conveyor structures that they may be rectilinearly moved from an operative position adjacent the head to a work position spaced therefrom, thereby enabling relatively free access to the head structure.

It will also be appreciated that where moving parts are involved, the production cost is correspondingly increased and as the parts are in the flow of the coating liquid, accurate mating of the parts is normally necessary and in most cases provision must be made for effecting a separation of the parts to insure proper cleaning thereof.

BRIEF SUMMARY OF THE INVENTION

The present invention is directed to a head structure which eliminates the disadvantages referred to, eliminating all individually movable parts, in the flow path of the coating liquid, defining the discharge slot. At the same time, the construction is such that it may be readily cleaned, with access to the interior of the head being readily achieved from the ends of the heat adjacent the respective sides of the machine, although, if desired, the head could readily be adapted to a pivoted type of support.

The portion of the head structure forming the retaining chamber for the coating liquid involves only three major components, a pair of end walls or members and an intermediate elongated body, preferably of single piece construction having an elongated slot extending longitudinally from one end thereof to the other which is adapted to be closed at its ends by the end walls.

The longitudinally extending discharge slot has a maximum width, when the body structure is in an unstressed condition, which is at least equal to the maximum width of the discharge slot desired, and adjustment is achieved by applying pressure on opposite sides of the body structure to urge the oppositely disposed edges of the longitudinal slot in directions toward one another to thereby reduce the effective width of the slot.

The means for effecting such adjustment may, for example, comprise respective members extending through the body from one side to the other thereof and provided with means for varying the effective length of such members to exert clamping forces on the opposite side of the body. Such members may, for example, be in the form of threaded bolts having an adjustable nut on at least one end thereof, so that by turning down the associated nut the desired clamping forces may be applied. By suitable selection of the threads of such members, a calibration may be readily effected and by means of external calibration marks the effective width of the slot may be readily adjusted in accordance with the specific calibration means involved.

If desired, the clamping means may take the form of suitable external clamping members, for example, generally corresponding to C-clamps or the like whereby the desired pressure may be applied to the body.

The end walls of the head may be readily mounted to the body for quick detachment therefrom to expose the open ends of the body and permit internal cleaning thereof.

As the body structure per se is adjustable, no separate adjusting elements are required and other than as to the removal of the end walls, no further dismantling of the structure is necessary. Likewise, the adjustment, if desired, may remain untouched during the cleaning operation, eliminating any resetting of the structure following cleaning.

Consequently, the invention offers advantages, not only as to production costs, but also in ease of adjustment, and ease of cleaning.

BRIEF DESCRIPTION OF THE DRAWINGS

In the drawings wherein like reference characters indicate like or corresponding parts.

DETAILED DESCRIPTION OF THE INVENTION

Figure 1:
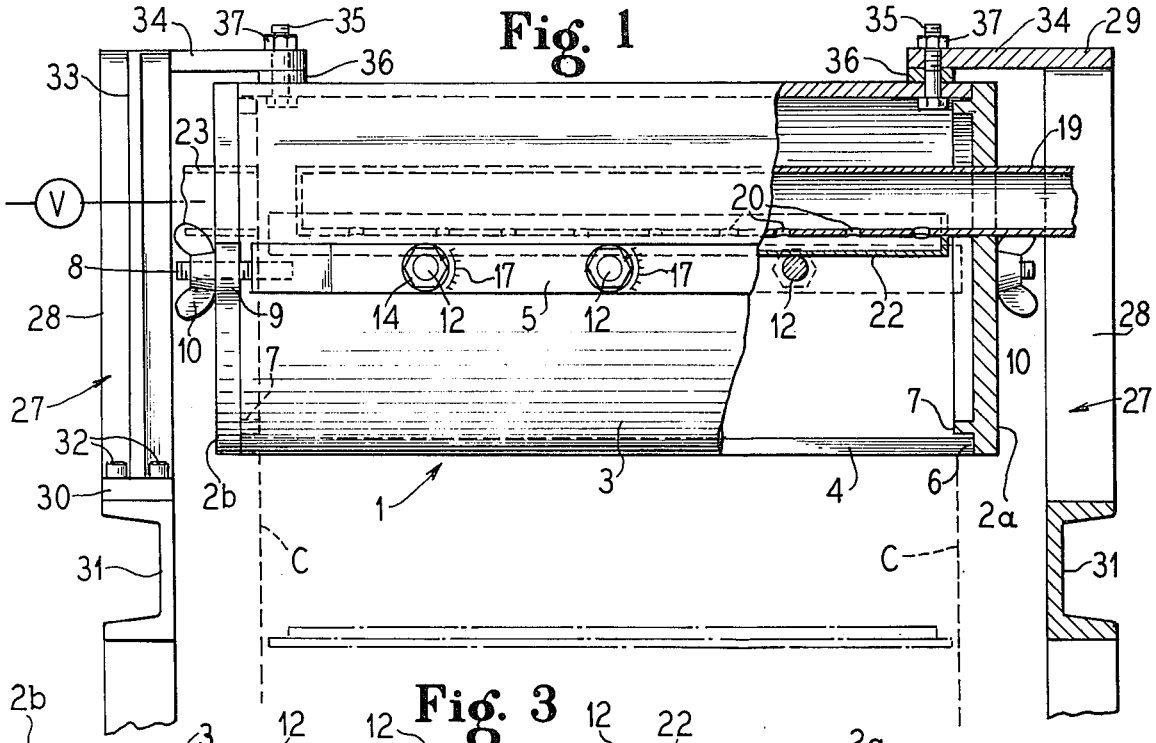
FIG. 1 is an elevational view of a flow coat head constructed in accordance with the invention, as viewed in the direction of travel of panels relative to the head.
Figure 3:
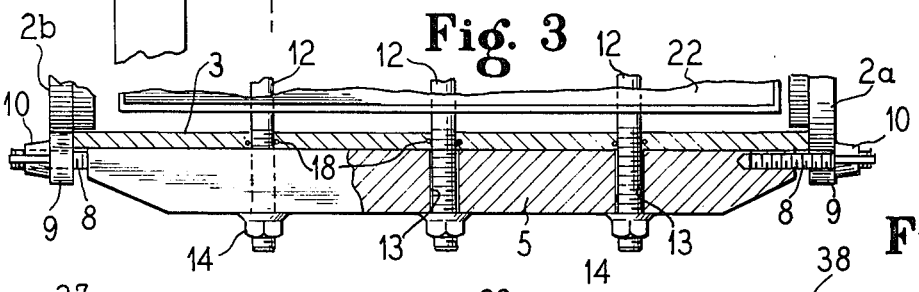
FIG. 3 is a sectional view taken approximately on the line III—III of FIG. 2.
Figure 2:
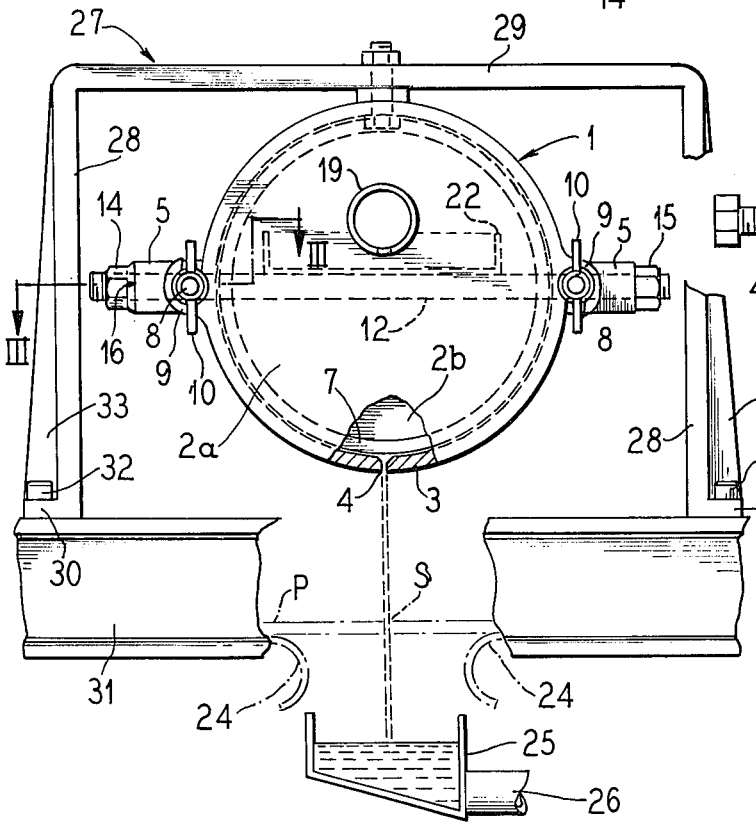
FIG. 2 is an end elevational view of the structure illustrated in FIG. 1, with portions of the latter broken away to illustrate details thereof.

Referring to the drawings, and in particular to FIGS. 1–3, the reference numeral 1 indicates generally a flow coat head comprising a pair of end walls 2*a* and 2*b* connected by an intermediate elongated tubular-shaped body 3 in the form of a hollow tube or pipe, provided at its bottom portion as viewed in FIGS. 1 and 2, with a longitudinally extending slot 4 which runs from one end edge of the body 3 to the other. Extending longitudinally along the side walls of the body 3, and, in the embodiment illustrated, disposed diametrically opposite one another, are respective reinforcing clamp bars 5, which preferably are rigidly secured to the wall of the body member 3 by suitable means as for example, welding.

As particularly illustrated in FIG. 3, the end walls 2*a* and 2*b* are provided with annular faces 6 extending between the outer peripheral edge of the associated wall and an annular flange 7 which extends inwardly into the body member 3. The respective faces 6 and abutting end edges of the body 3 are suitably machined or otherwise finished to provide good mating surfaces that will be fluid-tight with respect to the material to be contained within the body 3, when the end walls are operatively attached to the body 3.

As illustrated in FIGS. 6 and 3, the end walls 2*a* and 2*b* are adapted to be secured to the body member 3 by suitable means, as for example, studs 8 threaded or otherwise suitably mounted on the reinforcing bars 5. The studs 8 are adapted to extend through more or less C-shaped lugs 9 on the respective end walls and locked in position by suitable means such as wing nuts 10. This construction forms a secure, yet readily releasable connection between the body 3 and the associated end walls, as either of the latter may be readily removed by sufficiently backing off the associated wing nuts, after which the end wall may be rotated slightly in the right direction, for example, counterclockwise, with respect to the end wall 2*a* as viewed in FIG. 2, to disengage the lugs 11 on the respective end walls from the associated studs 8 and wing nuts 9, following which the end wall may be then readily removed from the body member 3 by outward movement in a direction along the axis of the body 3.

The slot 4 is suitably cut or otherwise formed in the body 3 with a width at least equal to the maximum desired operating width to be employed for the discharge slot, preferably slightly larger than such maximum operating width. Adjustment of the slot is effected by applying pressure on the opposite sides of the body member 3, i.e., at the clamp bars 5, whereby the opposite sides of the body member 3 may be urged towards one another to correspondingly narrow the slot 4. In the embodiment illustrated, this is accomplished by a plurality of members 12 which, in the embodiment illustrated, are in the form of threaded rods extending through the adjacent wall of the body member 3 and through bores 13 in the clamp bars 5 with retaining nuts 14 and 15 being threaded on the associated ends of the rods whereby pressure forces can be exerted on the clamping bars by suitable adjustment of the respective nuts. Preferably, the nuts 14 are provided with index marks 16 cooperable with graduations 17 on the adjacent face of the associated clamp bar whereby, in proper adjustment of the structure, such index marks may be used as indication of the adjusted width of the slot 4. Calibration of the graduations may be accomplished by adjustment of the nuts 15, with the latter and the associated rods preferably thereafter being suitably locked to the associated clamp bar 5 to prevent turning of the rod when the nut 14 is adjusted. Any suitable means may be employed for this purpose. For example, the adjacent end of the rod may be keyed or otherwise secured to the associated clamp bar to prevent rotation of the rod, but at the same time, permit axial adjustment thereof. Leakage around the rods 12 may be prevented by any suitable means, as for example, O-rings 18 disposed in cooperable recesses in the bores of the body 3, through which the rods 12 extend.

In the embodiment illustrated, the end wall 2*a* is provided with a fluid supply conduit 19 which extends through the side wall into the interior of the body member 3 and is provided with discharge openings 20 in the bottom portion thereof, through which the liquid may be discharged and received in a weir pan 22, which, in the embodiment of the invention illustrated, is adapted to rest upon and be supported by the rods 12. As a result of this construction, the liquid may overflow the longitudinal edges of the pan 22 whereby the liquid is directed generally along the lower portions of the side walls of the body to the slot 4 with a minimum of agitation of the liquid directly adjacent to or above the slot 4, to insure a smooth, even flow of such liquid through the slot.

The opposite end wall 2*b* may be provided with an overflow pipe 23, which in a gravity feed system would insure a maximum level of liquid in the body 3 and thus a constant flow characteristic at the slot 4. If a pressure feed were to be employed, as is in use with some types of equipment, a valve 24, diagrammatically illustrated may be employed in the overflow line 23. However, if the unit is to be designed solely for pressure feed operation, the overflow pipe 23 may then be omitted.

The head 1 is adapted to be suitably supported over a conveyor means, for example, conveyor belts 24 adapted to transport a panel disposed thereon past the slot 4, whereby liquid flowing from the slot 4 will form a sheet or curtain S indicated in dotted lines, being deposited on the panel and any excess at the edges being received in a suitable pan 25 or other container, which excess may be returned to the original supply source by means of a conduit 26. In many of the machines of this type, the liquid is recirculated by means of a pump, usually after passing through a suitable filter.

In the embodiment illustrated in FIGS. 1 and 2, the flow coat head is adapted to be supported above the conveyor belts 24 by means of respective generally inverted U-shaped brackets 27 having leg portions 28 and an intermediate connecting portion 29, the free bottom ends of the leg portions 28 are provided with oppositely disposed flanges 30 at their lower ends, secured to the conveyor frame member 31 by suitable means such as bolts 32 with the brackets. In the embodiment illustrated, being provided with stiffening ribs 33 adjacent each flange 30.

The intermediate cross member 29 of each bracket is provided with an elongated lug or arm 34 which arms extend in opposed relation and overlie the adjacent end portions of the body 3 with the latter being secured thereto by suitable means such as bolts 35 extending through the top portion of the body 3, and through corresponding bores in the arms 34. Interposed between the latter and the adjacent external surface of the body 3 are respective washers 36 which have concave lower surfaces which mate with the external surface of the body 3, nuts 37 threaded on the bolts 35, securing the body 3, and thus the head 1, in rigid relation, to the associated brackets. While normally, special sealing means are not required with respect to the bolts 35, if desirable, for example, where a pressure feed is involved, suitable sealing washers or the like also may be provided.

Figure 4:
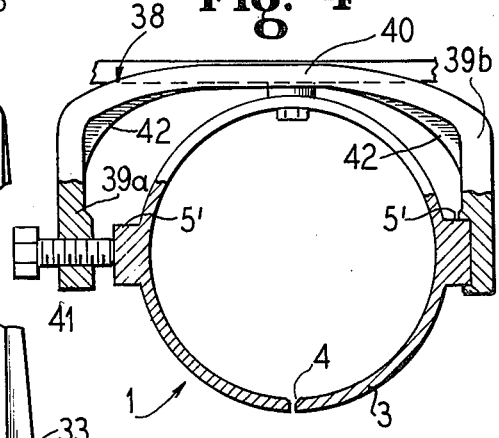
FIG. 4 is a transverse cross-sectional view similar to FIG. 2 illustrating a modified form of clamping structure.

FIG. 4 illustrates a modification of the construction illustrated in FIGS. 1–3 in connection with the means for applying compression forces to the body members 3 to effect adjustment of the slot 4 therein. In this construction, clamping bars 5' are of solid construction, i.e., without any bores therethrough or through the adjacent side wall of the body 3, with the clamping forces being provided by means of an external clamping member 38, of generally C-shaped configuration, providing downwardly depending leg portions **39*a* and 39*b* connected by an upper intermediate member 40 with the leg portion 39*b* suitably firmly engaged with the associated clamp bar 5' and the leg 39*a* being provided with an adjusting screw 41 suitably engageable with the adjacent clamp bar 5', for example, being seated in suitable recess in the adjacent face of the clamp bar to restrict lateral movement of the screw 41 with respect to the clamped bar. As illustrated, the clamp member 38 may be provided with suitable reinforcing ribs 42 or other means to insure adequate rigidity of the structure whereby the desired adjustment of the slot 4 may be achieved. It will be appreciated that either a single member 38 may be employed, of elongated construction and carrying a plurality of adjusting screws 41, or individual members 38 may be employed for each screw 41**.

In operation, the adjustment of the slot 4 is effected with the end walls **2*a* and 2*b* being in a slightly loosened condition, i.e., the wing nuts 9 being backed off slightly sufficient to permit the body 3 to contract or expand with adjustment of the nuts 14 until the desired width of the slot 4 is achieved. Upon completion of such adjustment, the wing nuts then may be firmly screwed down to rigidly secure the end walls to the body 3 in a liquid-tight relation. It will be noted that the internal flanges 7 on the respective end walls is provided with sufficient circumferential clearance on its outer periphery with respect to the inner surface of the body 3 that such flange will not interfere with adjusting movement of the body 3. As adjustment from a fraction of a millimeter to merely a plurality of millimeters is involved, the total movement of the body 3** is relatively small, whereby a correspondingly small clearance will be involved. To insure a vertical curtain sheet, i.e., prevent air currents from distorting the sheet, small chains C may be provided to define the vertical edges of the sheet and maintain them vertical.

Following the coating operation, the device may be readily cleaned by removing the end walls **2*a* and 2*b*, as previously described, with the supply conduit 19 and overflow conduit 23 being suitably connected by means of flexible connections or the like, whereby removal of the end walls will not be restricted by the respective conduits. Upon removal of the end walls and associated structure, the weir pan 22 may be readily removed and the entire interior of the body 3 efficiently cleaned by suitable means, as for example, brushes and suitable solvents, etc. As both ends are completely free and unrestricted by the brackets 27, the cleaning operation may be readily performed in a very simple manner. While the members 12 may also be removed in the cleaning operation, this normally will not be necessary so that no subsequent readjustment of the slot 4** will be required.

It will be appreciated from the above disclosure that I have provided a very simple head structure involving no individually movable parts to define the working discharge slot with the latter being formed directly in the body of the head. Consequently, the coating liquid does not come in contact at the discharge slot with any separate movable pieces or elements and only three basic elements are involved, i.e., the body 3 and end walls **2*a* and 2*b*. The adjusting structure is completely independent and remote from the discharge slot and while, in the construction of FIGS. 1 and 3, extend through the body 3, present no problems with respect to cleaning or adjustment and at the same time can be readily removed if desired. In the construction of FIG. 4, no internal parts are required within the body 3** other than might be associated with the supply and overflow conduits and weir pan, if employed.

Likewise, as previously described, the construction of the bracket 27 in conjunction with the end wall construction of the head enables a rapid disassembly of the structure and complete access to the interior of the body 3 from one end to the other. As no separate parts are associated with the slot 4, the latter likewise may be readily cleaned.

Needless to say, the construction is such that a considerable reduction in costs is achieved in its manufacture overheads involving a multiplicity of parts, movable plates, etc. and associated adjusting mechanism. Likewise, the cleaning operations do not require working from the top of the structure, but may be accomplished from either side, i.e., ends of the head, and at the same time, provide easier and more efficient cleaning than where a container, open at the top, must be cleaned.

Having thus described my invention, it will obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A flow coat head for curtain coating, particularly of sheet material, comprising a container for the coating material having a pair of end walls, and a pair of walls extending therebetween and connected to one another to form a relatively rigid body, said walls having spaced opposed edges, defining an elongated longitudinally extending slot therebetween at the bottom of the container, which slot forms the material discharge opening of the head, the end edges of at least one of said oppositely disposed walls being laterally movable, adjacent said slot, relative to the adjoining portions of said walls, said slot, in an unstressed condition of said body, having a transverse width equal to at least the maximum desired operating width, and means engaged with said laterally movable wall for applying pressure thereon, relative to the other of said oppositely disposed walls, greater than the normal inherent rigidity between said opposed walls, to relatively move the edges of said slot toward one another and thereby vary the effective width thereof.

2. A coating head according to claim 1, wherein said body is of elongated tubular shape, said elongated slot extending longitudinally continuously from one end of the body to the other, the body walls peripherally extending continuously from one of the longitudinal slot edges to the other thereof, said pressure-supplying means comprising adjustable means connecting the walls of said body at opposite sides of said slot operative to move said walls in directions to correspondingly move the edges of said slot toward one another and thereby vary the effective width thereof, and means for detachably securing the respective end walls to the body in fluid-tight relation.

3. A coating head according to claim 2, comprising in further combination, an inlet in one of said end walls for supplying coating material to said head.

4. A coating head according to claim 3, wherein said inlet is provided with a distribution manifold extending longitudinally inwardly from said end wall, and a weir pan operatively disposed below said manifold for receiving coating material therefrom, and having longitudinally extending side walls disposed adjacent the internal body wall surfaces whereby coating material is supplied to the body interior adjacent the side walls thereof.

5. A coating head according to claim 4, wherein said body is provided with an overflow outlet for coating material, whereby material flow to said discharge slot is by the action of gravity.

6. A coating head according to claim 4, wherein said overflow outlet is provided with a shut-off valve to enable operation with pressure feed of coating material.

7. A flow coat head for curtain coating, particularly of sheet material, comprising a container for the coating material, having a pair of end walls connected to an elongated tubular-shaped body formed from a one-piece length of cylindrical tubular stock, peripherally continuous with the exception of an elongated slot extending longitudinally therein continuously from one end of the body to the other, whereby the body wall peripherally extends continuously from one of its longitudinal slot edges to the other thereof, said slot forming the material discharge opening of the head and having a transverse width equal to at least the maximum desired operating width, and adjustable clamping means connecting the walls of the body at opposite sides of said slot, cooperable with said body to apply pressure thereto at opposite sides thereof substantially uniformly spaced from said slot in opposition to and overcoming the normal inherent rigidity of the body to move said walls in directions to correspondingly move the edges of said slot toward one another and thereby vary the effective width thereof.

8. A coating head according to claim 7, wherein said pressure-applying means comprises a plurality of members extending through opposite side walls of the body, and means external of the body walls for bearing the effective length of the rods to exert the desired pressure on said body.

9. A coating head according to claim 8, wherein said pressure-applying means includes respective clamp bars extending longitudinally along the body at opposite sides thereof with the pressure producing members being operable to apply pressure to said body through said clamped members.

10. A coating head according to claim 7, wherein said pressure-applying means comprises clamping means disposed externally of and partially encircling the body to provide body engaging elements at opposite sides thereof, at least one of which is adjustable relative to the other to enable adjustment of the pressure applied to said body.

11. A coating head according to claim 10, wherein said pressure-applying means includes respective clamp bars extending longitudinally along the body at opposite sides thereof with the pressure producing members being operable to apply pressure to said body through said clamped members.

12. A flow coat head for curtain coating, particularly of sheet material, comprising a container for the coating material having a pair of end walls, and a pair of walls connected to one another to form a relatively rigid body, said walls having spaced opposed edges defining an elongated longitudinally extending slot therebetween, which forms the material discharge opening of the head, the body, when unstressed having a normal inherent rigidity operative to dispose the edges of said slot in a predetermined spaced relation, and means engaged with said container for applying relative adjusting forces to said walls adjacent said slot, operative to overcome said normal rigidity and effect relative movement between said walls in opposition to said normal rigidity, in directions to provide a different predetermined spacing between said edges, and thereby provide a desired effective width of the discharge opening so formed.

13. A flow coat head for curtain coating, particularly of sheet material, comprising a container for the coating material having a pair of walls connected to one another to form a relatively rigid body, said walls having free bottom edges spaced from one another to define an elongated longitudinally extending slot therebetween, the body, when unstressed, having a normal inherent rigidity operative to dispose the edges of said slot in predetermined relation, to form a slot having a width at least equal to the maximum desired operating width of the discharge opening, and means engaged with said body at opposite sides of said slot for applying adjusting compression forces to said walls, operative to overcome said normal rigidity and move the corresponding bottom edges of said walls toward one another to provide a predetermined lessor spacing between said edges, and thereby provide a narrower effective width of the discharge opening so formed.

* * * * *